US010869589B2

(12) United States Patent
Kendall et al.

(10) Patent No.: US 10,869,589 B2
(45) Date of Patent: Dec. 22, 2020

(54) DISH TREATING APPLIANCE DOOR ASSEMBLY

(71) Applicant: WHIRLPOOL CORPORATION, Benton Harbor, MI (US)

(72) Inventors: James W. Kendall, Mount Prospect, IL (US); Darryl C. Bodine, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 213 days.

(21) Appl. No.: 15/692,273

(22) Filed: Aug. 31, 2017

(65) Prior Publication Data

US 2019/0059693 A1 Feb. 28, 2019

(51) Int. Cl.
*A47L 15/42* (2006.01)

(52) U.S. Cl.
CPC ..... *A47L 15/4259* (2013.01); *A47L 15/4261* (2013.01)

(58) Field of Classification Search
None
See application file for complete search history.

(56) References Cited

U.S. PATENT DOCUMENTS 3,997,201 A * 12/1976 DeSchaaf ..... A47L 15/4259 292/173
D667,596 S 9/2012 Berberet
8,740,320 B2 6/2014 Eng
9,005,371 B2 4/2015 Egger et al.
2007/0159454 A1 7/2007 Rodriguez et al.
2013/0113351 A1* 5/2013 Eng ..... A47L 15/4257 312/228.1
2013/0300268 A1 11/2013 Schaefer et al.
2015/0192288 A1* 7/2015 Kim ..... F21V 33/0044 362/253
2017/0096837 A1* 4/2017 Criner ..... A47L 15/4257

FOREIGN PATENT DOCUMENTS

EP 2514350 A1 10/2012
WO 2014101930 A1 7/2014

OTHER PUBLICATIONS http://www.bosch-home.com/us/SHP7PT55UC.html, Bosch Pocket Handle Dishwasher #SHP7PT55UC, accessed Aug. 31, 2017.
http://www.samsung.com/us/home-appliances/dishwashers/waterwall/dw80j7550ug-top-control-dishwasher-with-waterwall-technology-black-stainless-steel-dw80j7550ug-aa/, Samsung Top Control Dishwasher Model #DW80J7550UG, accessed Aug. 31, 2017.

* cited by examiner

*Primary Examiner* — Rita P Adhlakha
(74) *Attorney, Agent, or Firm* — McGarry Bair PC

(57) ABSTRACT

A dish treating appliance for treating dishes including a tub at least partially defining a treating chamber having an access opening and a door moveable between opened and closed positions to selectively open and close the access opening that includes a front panel and a handle assembly mounted to the front door panel.

19 Claims, 5 Drawing Sheets

DISH TREATING APPLIANCE DOOR ASSEMBLY

BACKGROUND OF THE INVENTION

Front loading dishwashers include a tub having an open front. The tub defines a washing chamber into which dishes are placed to undergo a washing operation. The dishwasher is generally provided with a door assembly, pivotally mounted to the tub that closes the open front during the washing operation.

Typically, the door assembly configurations are defined by multiple pieces including a front panel, a top cap, a handle, and user controls that require multiple door panel shapes and configurations to accommodate different features.

BRIEF DESCRIPTION OF THE INVENTION

In one aspect of the present disclosure, a dish treating appliance for treating dishes can comprise: a tub at least partially defining a treating chamber with an access opening; a door movable between opened/closed positions to selectively open/close the access opening and comprising: a front door panel defining a face panel with a face opening, opposing side edges extending rearwardly from the face panel, and an open top edge, and a handle assembly mounted to the front door panel and having a hand panel closing the face opening and a top cap closing the open top edge; whereby the hand panel is accessible through the face opening when the handle assembly is mounted to the front door panel.

In another aspect of the present disclosure, a door assembly for a dishwasher can comprise: a front door panel defining a face panel with a face opening, opposing side edges extending rearwardly from the face panel, and an open top edge, and a handle assembly mounted to the front door panel and having a hand panel closing the face opening and a top cap closing the open top edge; whereby the hand panel is accessible through the face opening when the handle assembly is mounted to the front door panel.

In another aspect of the present disclosure, a method of forming a dishwasher door assembly can comprise: assembling a handle assembly comprising a hand panel and a top cap, with a front door panel having a face opening and opposing side edges extending rearwardly from the face panel and an open top edge, wherein the hand panel is accessible through the face opening when the handle assembly is mounted to the front door panel to form the dishwasher door assembly.

DESCRIPTION OF EMBODIMENTS OF THE INVENTION

Figure 1:
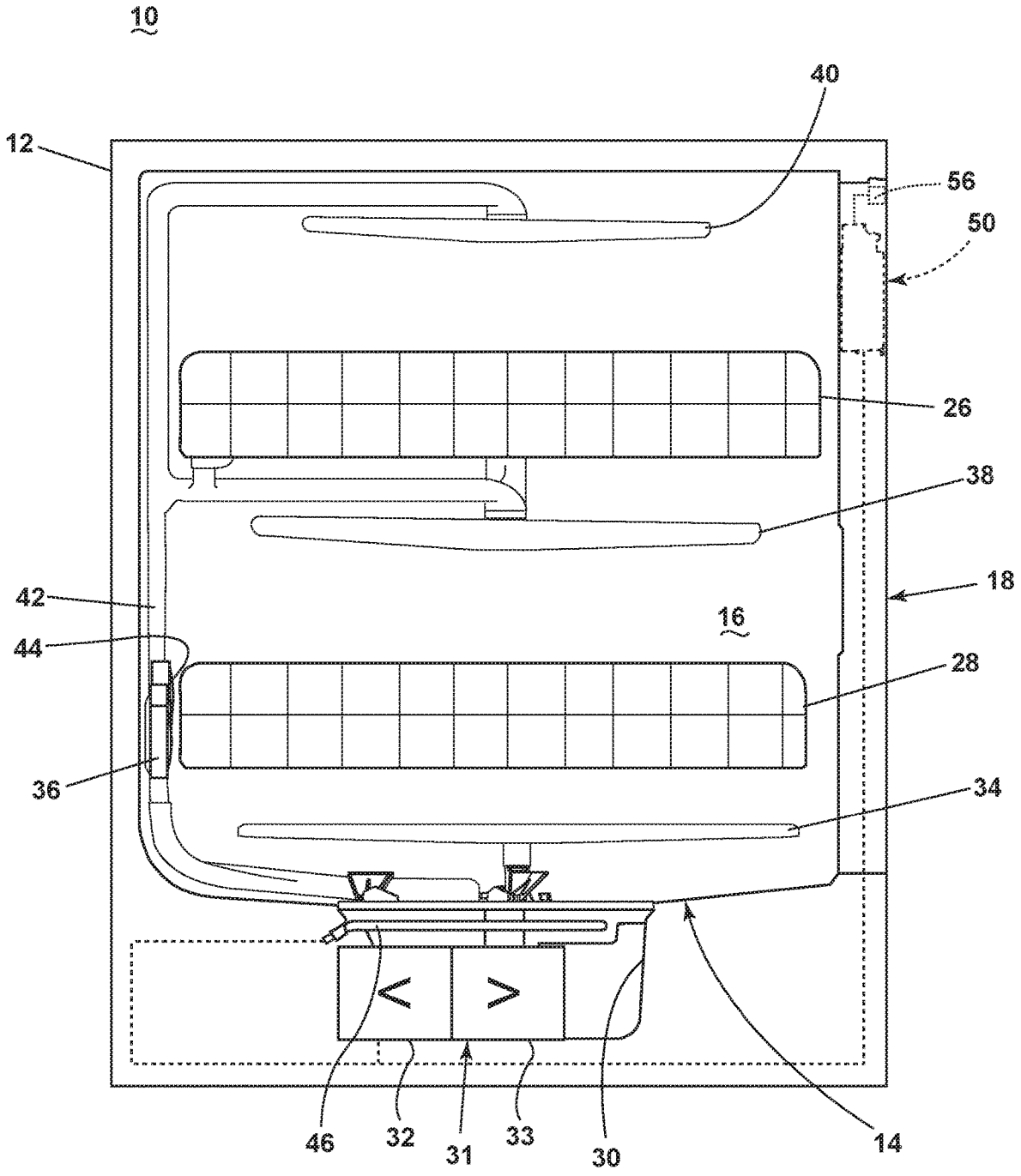
FIG. 1 is a schematic, cross-sectional view of a dishwasher according to aspects of the present disclosure.

In FIG. 1, an automated dishwasher 10 according to a first embodiment is illustrated. The dishwasher 10 shares many features of a conventional automated dishwasher, which will not be described in detail herein except as necessary for a complete understanding of the invention. A chassis 12 may define an interior of the dishwasher 10 and may include a frame, with or without panels mounted to the frame. An open-faced tub 14 can be provided within the chassis 12 and may at least partially define a treating chamber 16, having an open face, for washing dishes. A door assembly 18 can be movably mounted to the dishwasher 10 for movement between opened and closed positions to selectively open and close the open face of the tub 14. Thus, the door assembly 18 provides accessibility to the treating chamber 16 for the loading and unloading of dishes or other washable items.

It should be appreciated that the door assembly 18 can be secured to the lower front edge of the chassis 12 or to the lower front edge of the tub 14 via a hinge assembly (not shown) configured to pivot the door assembly 18. When the door assembly 18 is closed, user access to the treating chamber 16 may be prevented, whereas user access to the treating chamber 16 may be permitted when the door assembly 18 is open.

Dish holders, illustrated in the form of upper and lower dish racks 26, 28, are located within the treating chamber 16 and receive dishes for washing. The upper and lower racks 26, 28 are typically mounted for slidable movement in and out of the treating chamber 16 for ease of loading and unloading. Other dish holders may be provided, such as a silverware basket. As used in this description, the term "dish(es)" is intended to be generic to any item, single or plural, that may be treated in the dishwasher 10, including, without limitation, dishes, plates, pots, bowls, pans, glassware, and silverware.

A spray system is provided for spraying liquid in the treating chamber 16 and is provided in the form of a first lower spray assembly 34, a second lower spray assembly 36, a rotating mid-level spray arm assembly 38, and/or an upper spray arm assembly 40. Upper sprayer 40, mid-level rotatable sprayer 38 and lower rotatable sprayer 34 are located, respectively, above the upper rack 26, beneath the upper rack 26, and beneath the lower rack 28 and are illustrated as rotating spray arms. The second lower spray assembly 36 is illustrated as being located adjacent the lower dish rack 28 toward the rear of the treating chamber 16. The second lower spray assembly 36 is illustrated as including a vertically oriented distribution header or spray manifold 44.

A recirculation system is provided for recirculating liquid from the treating chamber 16 to the spray system. The recirculation system may include a sump 30 and a pump assembly 31. The sump 30 collects the liquid sprayed in the treating chamber 16 and may be formed by a sloped or recess portion of a bottom wall of the tub 14. The pump assembly 31 may include both a drain pump 32 and a recirculation pump 33. The drain pump 32 may draw liquid from the sump 30 and pump the liquid out of the dishwasher 10 to a household drain line (not shown). The recirculation pump 33 may draw liquid from the sump 30 and the liquid may be simultaneously or selectively pumped through a supply tube 42 to each of the assemblies 34, 36, 38, 40 for selective spraying. While not shown, a liquid supply system may include a water supply conduit coupled with a household water supply for supplying water to the treating chamber 16.

A heating system including a heater 46 may be located within the sump 30 for heating the liquid contained in the sump 30.

A controller 50 may also be included in the dishwasher 10, which may be operably coupled with various components of the dishwasher 10 to implement a cycle of operation. The controller 50 may be located within the door 18 as illustrated, or it may alternatively be located somewhere within the chassis 12. The controller 50 may also be operably coupled with a control panel or user interface 56 for receiving user-selected inputs and communicating information to the user. The user interface 56 may include operational controls such as dials, lights, switches, and displays enabling a user to input commands, such as a cycle of operation, to the controller 50 and receive information.

As the exact structure and operation of the spray, recirculation or heating assemblies of dishwasher 10 are not part of the present invention, it will not be discussed further herein. Instead, the present invention is directed to the particular details of the configuration and function of door assembly 18. However, it should be noted that the invention can be employed in connection with various types of dishwashers, including the conventional type of FIG. 1 and drawer dishwashers.

Figure 2:
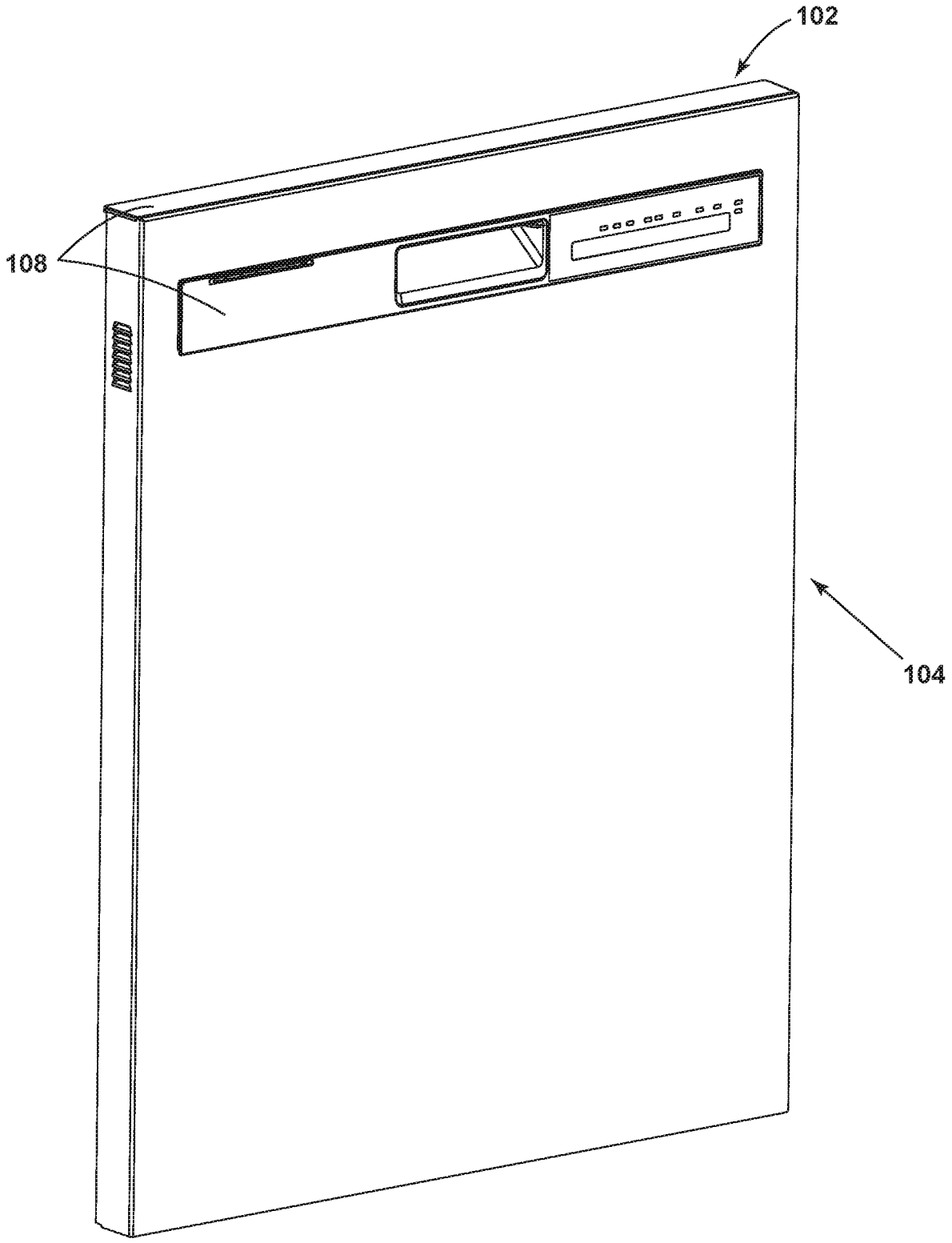
FIG. 2 is a top perspective view of a door assembly of the dishwasher of FIG. 1 according to aspects of the present disclosure.

FIG. 2 illustrates a top perspective view of an exemplary door assembly 18 with an outer door panel assembly 102 comprising a front door panel 104 and a single component, integrally formed, handle assembly 108 of uniform construction coupled to the front door panel 104.

Figure 3:
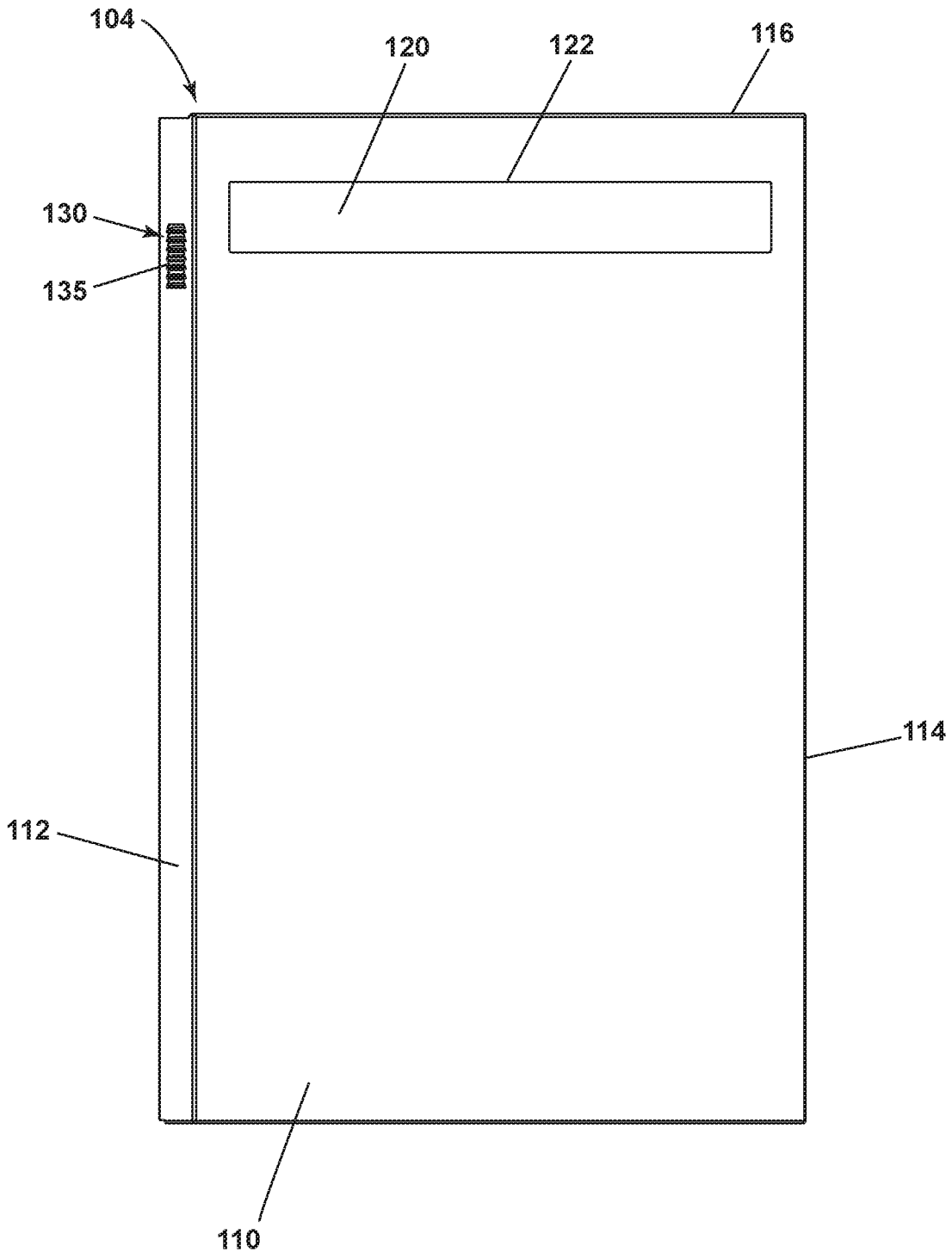
FIG. 3 is a perspective view of an exemplary front door panel of a door assembly of FIG. 2 according to aspects of the present disclosure.

Referring to FIG. 3, the front door panel 104 comprises a face panel 110 and two opposing side edges 112, 114 which extend rearwardly from the face panel 110 to form the side walls of the front door panel 104. The side edges 112, 114 can be separately or integrally formed with the face panel 110. The top edge of the face panel 110 together with the top edge of both opposing side edges 112 and 114 can form an open top edge 116 of the front door panel 104. The front door panel 104 can be constructed of stainless steel, painted steel, surface coated stainless steel, plastic, other metal, or any such material able to withstand the conditions of the dishwasher 10.

The face panel 110 can further comprise a face opening 120 defined by a periphery 122. The face opening 120 can be substantially rectangular, however, the face opening 120 can be of any shape suitable and size as to receive the handle assembly 108. The periphery 122 defines an outside surface of the face opening 120. In aspects of the present disclosure, the face opening 120 extends horizontally in a center portion of an upper end of the face panel 110. Alternatively, the face opening 120 can be located on any portion of the front door panel 104 suitable for structurally maintaining the opening and supporting the handle assembly 108.

The face panel 110 can optionally comprise a fastener or a fastening element (not shown) at the periphery 122 for receiving the handle assembly 108 such as an adhesive, a gasket, a receiving edge, a catch, a rivet, a snap-fit locking mechanism, or any suitable means to secure the handle assembly 108 in the face opening 120 adjacent to, in contact with, or on the periphery 122.

The front door panel 104 can further comprise a vent 130. The vent 130 can comprise one or more apertures 135 in the form of slots, holes, or other openings in the front door panel 104 through which air and/or moisture can pass, can be provided on the face panel 110, on one or more of the side edges 112 and 114, or a combination of both.

Figure 4:
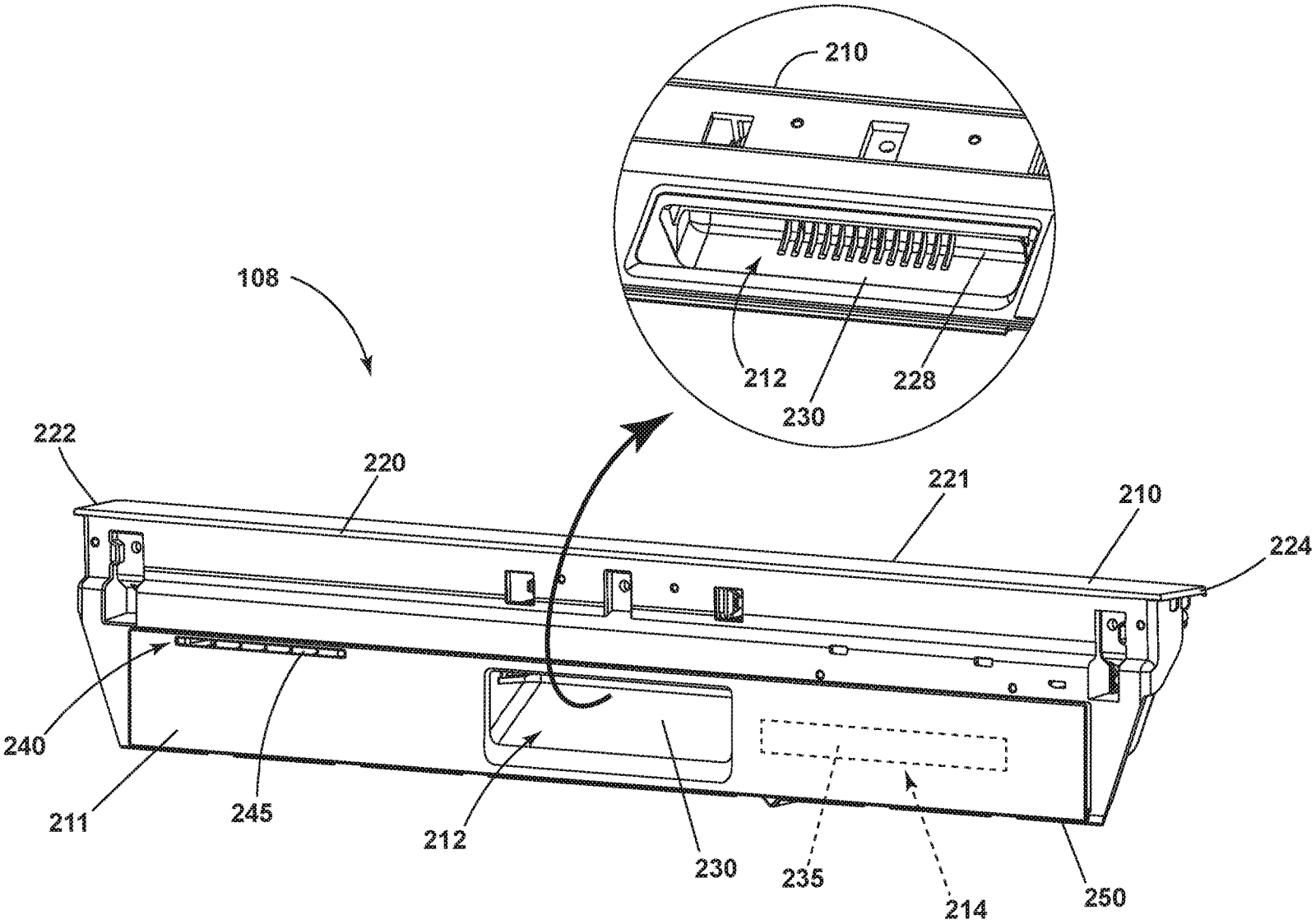
FIG. 4 is a perspective front view of an exemplary handle assembly of a door assembly of FIG. 2 according to aspects of the present disclosure.

FIG. 4, illustrates an exemplary handle assembly 108 for mounting to the front door panel 104. The handle assembly 108 can be fastened to a rear portion of the front door panel 104 by any means suitable for fastening including, but not limited to, a weld, a latch, a snap-fit mechanism, a catch, an adhesive, a pin, a bolt, or a screw. The handle assembly 108 comprises a top cap 210 and a hand panel 211 such that when the handle assembly 108 is mounted to the front door panel 104, the top cap 210 closes the open top edge 116 of the front door panel 104, while the hand panel 211 closes the face opening 120 of the front door panel 104. Handle assembly 108 can further comprise a lip 250 provided on hand panel 211 that engages the periphery 122 of the face opening 120. The lip 250 can be provided along one or more edges of the hand panel 211 in which to engage the periphery 122 or any outside surface of the face opening 120. In aspects of the present disclosure, lip 250 is located along a bottom edge of the hand panel 211 to engage the periphery 122. The lip 250 can sit on a bottom edge of the periphery 122 such that the periphery 122 supports at least some of the weight of the handle assembly 108. The lip 250 allows for simple alignment and fastening or coupling of the handle assembly 108 to the front panel 104. Alternatively, the lip 250 can be continuous and surround the entire hand panel 211 and engage the entire periphery 122. In another aspect of the present disclosure, the hand panel 211 can be received in the face opening 120 in a flush arrangement with the periphery 122. The handle assembly 108 can be constructed of plastic, stainless steel, other metal, or any such material able to withstand the conditions of the dishwasher 10.

The top cap 210 can be defined by a front edge 220, rear edge 221, and spaced apart side edges 222 and 224 that define the periphery of the top cap 210. When installed in the front door panel 104, the front edge 220 can be located on or adjacent to the open top edge 116 of the front door panel 104. The top cap 210 can extend along the open top edge 116 between the opposing side edges 112 and 114 such that the top cap 210 closes the open top edge 116 of the front door panel 104. The open top edge 116 can comprise a seat on which to receive one of each of the side edges 222 and 224 of the top cap 210.

The handle assembly 108 can also comprise a hand panel 211 integrally formed with top cap 210. The hand panel 211 can be defined by a pocket handle housing 212, a front control surface 214, and a vent structure 240 The periphery of the hand panel 211 can be complimentary in shape to the face opening 120 of the front door panel 104 such that the hand panel 211 can be received in the face opening 120. The hand panel 211 can further comprise a vent 240. The vent 240 can comprise one or more apertures 245 in the form of slots, holes, or other openings in the first panel 104 through which air and/or moisture can pass.

The pocket handle housing 212 can be integrally formed with and located on the front of the hand panel 211. The pocket handle housing 212 can extend all or a portion of the horizontal length of the hand panel 211. Furthermore, the pocket handle housing 212 can extend across all or a portion of the vertical length of the hand panel 211. The pocket handle housing 212 can receive a handle cap 228 (as shown in the enlarged portion of FIG. 4) to form a handle 230 that can enable a user to open and/or close the dishwasher door assembly 18. In aspects of the present disclosure, the handle cap 228 can comprise a cup shape, forming the handle 230 as a pocket handle that enables a user's hand to grasp an inside edge of the cup-shaped ingress to pull the door assembly 18 and access the treating chamber 16. The pocket handle 230 can be accessed by a user through the face opening 120 when the handle assembly 108 is mounted to the front door panel 104. The pocket handle 230 can be located in the center of the face opening 120. Alternatively, the handle 230 can be any suitable handle such as, but not limited to, a handle pull, a tabbed handle, or a flanged handle. In addition, decorative parts could be added to the handle assembly 108. For example, the handle assembly 108 could be a drawer pull to match the kitchen cabinet or metal, plastic or wood laminate could be added to the front surface for styling purposes. Furthermore, the pocket handle housing 212 can be alternatively integrated with the face panel 110 of the front door panel 104, or the pocket handle housing 212 can be provided on the top cap 210.

In aspects of the present disclosure, the front control surface 214 can be integrally formed with and located on the front of the hand panel 211 and can be accessed through the face opening 120. The front control surface 214 can be located to above, below, left or right of the pocket handle housing 212 on the hand panel 211. Alternatively, the front control surface can be located in the pocket handle housing 212. Furthermore, the front control surface 214 can alternatively be integrated with the face panel 110 of the front door panel 104, or the front control surface 214 can be provided on the top cap 210.

The front control surface 214 can comprise a control pad 235 that can include the user interface 56. The control pad 235 can comprise one or more components and/or operational controls of the user interface 56 or controller 50 can pass or be integrated. Such components may include, but not be limited to, operational controls such as dials, lights, switches, displays enabling a user to input commands to the controller 50, and output displays, from the controller 50 enabling a user to receive information.

Figure 5:
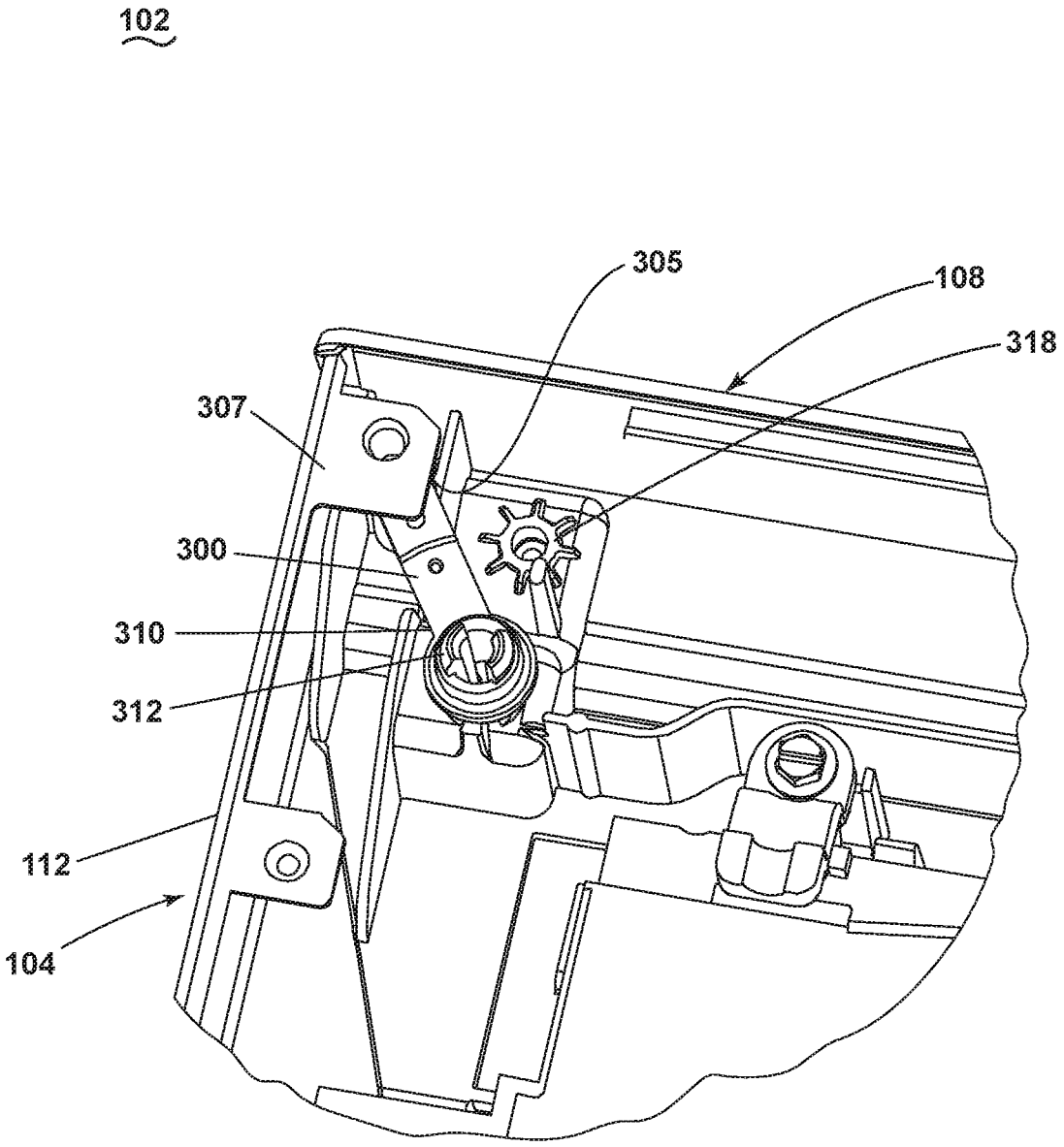
FIG. 5 is a perspective rear view of an outer door assembly of the door assembly of FIG. 2 according to aspects of the present disclosure.

Referring to FIG. 5, the outer door panel assembly 102 can further comprise a swinging spacer 300 for helping secure the hand panel assembly 108 to the front door panel 104. The swinging spacer 300 has a first end 305 that can be received in a tab 307 integrally formed with each of the opposing side edges 112, 114 of the front panel 104, and a second end 310 that can receive a fastening element 312 of the handle assembly 108. The swinging spacer 300 turns into place once the handle assembly 108 is seated in the front panel 104. In one aspect of the present disclosure, the second end 310 of the swinging spacer 300 snap fits onto the fastening element 312 and is secured to the handle assembly 108. The first end 305 then rotates or clicks in one direction to be received in tab 307 of the front panel 104. Once the swinging spacer 300 is rotated, a screw hole 318 in the handle assembly 108 is exposed such that an assembly screw for attaching a rear panel (not shown) onto the outer door panel assembly 102 can then be driven through the rear panel, through the tab 307, through the first end 305, and into the screw hole 318 to sandwich the door assembly 18 without bending the tab 307. The rotating spacer 300 can comprise a gasket, a receiving edge, a catch, a rivet, a snap-fit locking mechanism, or any suitable means to secure the handle assembly 108 to front panel 104.

While aspects of the present disclosure been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A dish treating appliance for treating dishes, comprising:

a tub at least partially defining a treating chamber with an access opening;

a door movable between an opened position and a closed position to selectively open and close the access opening, the door comprising:

a front door panel defining a forwardmost face panel with a face opening defined by a periphery within the forwardmost face panel, opposing side edges extending rearwardly from the forwardmost face panel, and an open top edge; and a handle assembly mounted to the front door panel and having a hand panel received in the periphery within the forwardmost face panel and a top cap closing the open top edge, the hand panel accessible through the face opening when the handle assembly is mounted to the front door panel, the hand panel and top cap being unitarily formed to close both the open top edge and the face opening when the handle assembly is mounted to the front door panel.

2. The dish treating appliance of claim 1, further comprising a pocket handle housing integrally formed with the hand panel.

3. The dish treating appliance of claim 2, further comprising a handle cap receivable within the pocket handle housing, the handle cap forming a cup shape and defining a pocket handle.

4. The dish treating appliance of claim 3 wherein the pocket handle is accessible through the face opening.

5. The dish treating appliance of claim 3 wherein the pocket handle is centered in the face opening.

6. The dish treating appliance of claim 1 wherein the hand panel and the face opening are flush when the handle assembly is mounted to the front door panel.

7. The dish treating appliance of claim 1 wherein the front door panel is one of stainless steel, painted steel, or surface coated stainless steel.

8. The dish treating appliance of claim 7 wherein the handle assembly is plastic.

9. The dish treating appliance of claim 1 wherein the hand panel further comprises a lip engaging an outside surface of the face opening.

10. The dish treating appliance of claim 9 wherein the lip further comprises an adhesive for engaging an inside surface of the face opening.

11. The dish treating appliance of claim 1, further comprising a front control surface integrally formed with one of a front of the hand panel or the top cap.

12. The dish treating appliance of claim 11 wherein the front control surface is accessible through the face opening.

13. The dish treating appliance of claim 1, further comprising a swinging spacer for mounting the handle assembly to the front door panel.

14. A door assembly for a dishwasher, comprising:

a front door panel defining a face panel, defining a flat front panel with a face opening defined in the flat front panel, opposing side edges extending rearwardly from the face panel, and an open top edge;

a single component, integrally formed handle assembly mounted to the front door panel and having an integral body including a hand panel and a top cap, the hand panel closing the face opening and the top cap closing the open top edge, the hand panel is accessible through the face opening when the single component, integrally formed handle assembly is mounted to the front door panel; and a control surface including a user interface integrated on the hand panel and accessible through the face opening or provided on the top cap.

15. The door assembly of claim 14 wherein the hand panel further comprises a pocket handle housing.

16. The door assembly of claim 15 wherein the pocket handle housing is accessible through the face opening and includes the control surface located therein.

17. The door assembly of claim 14 wherein the front door panel is stainless steel and the single component, integrally formed handle assembly is plastic.

18. A method of forming the dishwasher door assembly of claim 14, the method comprising assembling the single component, integrally formed handle assembly having an integral body comprising the hand panel and the top cap, with the front door panel having the face panel, the face opening, and the opposing side edges extending rearwardly from the face panel and the open top edge, wherein the hand panel is accessible through the face opening when the single component, integrally formed handle assembly is mounted to the front door panel to form the dishwasher door assembly.

19. The door assembly of claim 14 wherein the integral body includes a uniform construction.

* * * * *